US009314909B2

(12) United States Patent
Vaamonde Coton et al.

(10) Patent No.: US 9,314,909 B2
(45) Date of Patent: Apr. 19, 2016

(54) DISMANTLEABLE TUBULAR GRIPPING ELEMENT

(75) Inventors: Luis Vaamonde Coton, Vigo-Pontevedra (ES); Michael William Perez Trigano, Vigo-Pontevedra (ES)

(73) Assignee: MICATON ERGONOMICS, S.L., Vigo-Pontevedra (ES)

( * ) Notice: Subject to any disclaimer, the term of this patent is extended or adjusted under 35 U.S.C. 154(b) by 305 days.

(21) Appl. No.: 14/005,858

(22) PCT Filed: Mar. 21, 2012

(86) PCT No.: PCT/ES2012/070184

§ 371 (c)(1),
(2), (4) Date: Nov. 22, 2013

(87) PCT Pub. No.: WO2012/127092

PCT Pub. Date: Sep. 27, 2012

(65) Prior Publication Data

US 2014/0060267 A1 Mar. 6, 2014

(30) Foreign Application Priority Data

Mar. 21, 2011 (ES) ..... 201130400

(51) Int. Cl.
*B25B 23/10* (2006.01)
*B25B 23/12* (2006.01)
*B25B 23/00* (2006.01)

(52) U.S. Cl.
CPC ..... *B25B 23/10* (2013.01); *B25B 23/005* (2013.01); *B25B 23/101* (2013.01); *B25B 23/12* (2013.01)

(58) Field of Classification Search
CPC ..... B25B 15/02; B25B 23/10; B25B 23/12; B25B 23/101; B25B 23/005
USPC ..... 81/451, 125
See application file for complete search history.

(56) References Cited

U.S. PATENT DOCUMENTS

| | | | |
|---|---|---|---|
| 739,606 | A | 9/1903 | Kemm |
| 797,078 | A | 8/1905 | Shelton |
| 1,360,500 | A | 11/1920 | Coll |
| 1,421,535 | A | 7/1922 | Murdock |
| 1,889,330 | A | 11/1932 | Humes et al. |
| 2,248,054 | A | 7/1941 | Becker |
| 2,688,991 | A | 9/1954 | Doyle |
| 2,723,694 | A | 11/1955 | Ross |
| 2,985,208 | A | 5/1961 | Hibbard et al. |
| 3,245,446 | A | 4/1966 | Morifuji |

(Continued)

FOREIGN PATENT DOCUMENTS

| | | |
|---|---|---|
| DE | 18 85 194 U | 12/1963 |
| DE | 34 23 881 A1 | 1/1986 |

(Continued)

*Primary Examiner* — Hadi Shakeri
(74) *Attorney, Agent, or Firm* — Gottlieb, Rackman & Reisman P.C.

(57) ABSTRACT

It is equipped with two openings (1, 10) and has an external surface of several stretches of reduced thickness and consistent in each one of its radial cross-sections. It is of flexible material and comprises a bumpy first stretch (5) defined by parallel perimeter grooves (14). It can be used on tools, especially screwdrivers, and facilitates the coupling of the screw head to the screwdriver through one of its openings or optionally through the magnetic attraction exerted by a built-in magnet (8). Likewise, it can be applied to writing tools, such as propelling pencils or ballpoint pens.

9 Claims, 10 Drawing Sheets

(56) References Cited

U.S. PATENT DOCUMENTS

| | | | | |
|---|---|---|---|---|
| 3,253,626 | A | 5/1966 | Stillwagon, Jr. et al. | |
| 5,029,498 | A | 7/1991 | Kinsey | |
| 5,065,649 | A | 11/1991 | Evers et al. | |
| 5,309,799 | A * | 5/1994 | Jore | B25B 15/00 81/451 |
| 5,458,030 | A * | 10/1995 | Betts | B25B 23/005 81/451 |
| 5,724,873 | A * | 3/1998 | Hillinger | B25B 23/12 81/125 |
| 6,273,626 | B1 | 8/2001 | Yazawa | |
| 6,520,509 | B1 | 2/2003 | Vasudeva | |
| 7,107,882 | B1 | 9/2006 | Chang | |
| 7,574,946 | B1 | 8/2009 | Chang | |
| 8,726,769 | B1 * | 5/2014 | Jacker | B25B 23/101 81/451 |
| 2005/0098002 | A1 | 5/2005 | Holland-Letz | |
| 2007/0295172 | A1 | 12/2007 | Swartz | |
| 2010/0011918 | A1 | 1/2010 | Ray | |

FOREIGN PATENT DOCUMENTS

| | | | |
|---|---|---|---|
| DE | 88 01 252 | U1 | 3/1989 |
| DE | 20 2004 016173 | U1 | 3/2006 |
| DE | 20 2006 015494 | U1 | 2/2008 |
| DE | 20 2010 006438 | U1 | 9/2010 |
| EP | 0 596 669 | A1 | 5/1994 |
| GB | 2 234 695 | A | 2/1991 |
| JP | 2005-169584 | A | 6/2005 |

* cited by examiner

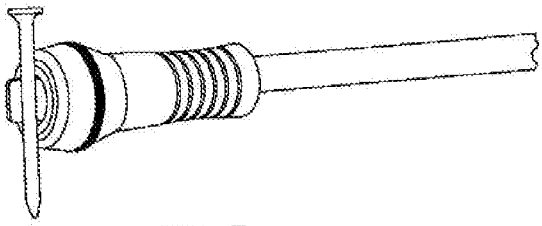
FIG. 12
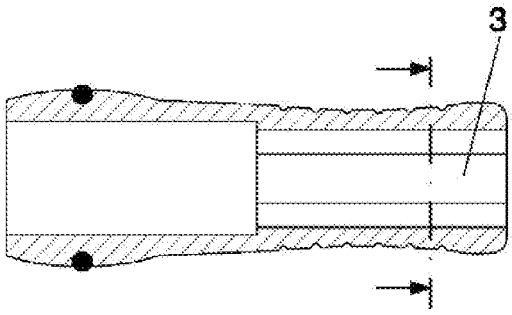
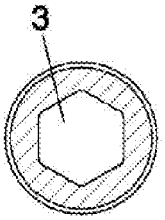
FIG. 13A
FIG. 13
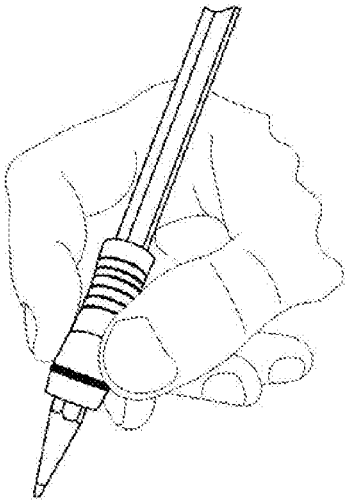
FIG. 14

DISMANTLEABLE TUBULAR GRIPPING ELEMENT

OBJECT OF THE INVENTION

The present invention relates to a removable tubular gripping element which can be used on tools, especially screwdrivers, as well as on writing instruments, such as propelling pencils or ballpoint pens.

The object of the invention consists of a tubular element which can be adapted to a screwdriver which facilitates the coupling of the screw head to the screwdriver through one of the openings thereof, or optionally through the magnetic attraction exerted by a built-in magnet in the tubular element, thus facilitating the fastening of the screw. Likewise, the tubular element makes it possible the handling of the screwdriver, contributing to increase the torque and the precision in the screwing and unscrewing operations near the tip or indentation of the rod.

BACKGROUND OF THE INVENTION

In the field of tools, and more specifically relating to screwdrivers, the use of magnetised materials at the tip is known to facilitate the gripping of the screw head, so that the operation of turning it is facilitated by the magnetised material used to keep the screw held in place. These types of screwdrivers generally feature the drawback that they do not have a sufficient force of attraction to guarantee a positional stability of the screw and prevent the need for one to use their other hand to hold the screw in place.

Some solutions intended to resolve this drawback are known, such as the case of patent of application DE202004016173, which discloses a magnetic screw holder which is built into the rod and has a magnet at the tip in the shape of a cap which would facilitate the attraction of the screw, overcoming the abovementioned drawback. However, this cannot be separated; the body is rigid and requires the use of coupling means which establishes connection thereof with the screwdriver. All of this increases the cost of the array.

Another solution included in the patent of application WO2008043514 claims a hard plastic tubular element, which can only be adapted to cylindrical rod screwdrivers, and is equipped with fixing elements which, by means of screwing, establish its link to the screwdriver rod in a specific position to adapt the position of the magnet to the depth of the hollow of the screw head. This mode of fastening is inconvenient when the operating conditions require movement back to its original position.

In the patent of application DE102009003404, a non-magnetic screw-finder that has a tubular configuration for the coupling thereof by sliding in the screwdriver rod is disclosed, made of elastomeric plastic and having stubs or claws made of another, harder plastic material, which extend from one of its ends and which are devised to hold the screw head. These stubs cause the system to be complex, bulky, difficult to handle, and since there is partial contact between the screw head and the stubs, the screw can wobble easily.

Other tubular gripping elements have a rigid, cylindrical body configuration that extends in generally metallic, flexible stubs, near their ends, to couple to the rod, resulting in an unsuitable solution due to the positional instability offered, and have low or null electrical insulation.

Other devices are arranged along the entire rod so that they can be actuated from the screwdriver handle itself. This requires plenty of dexterity from the user and their connection to the screwdriver makes them bulkier and more costly.

All of these examples have a single operational sense, in that they fix to the rod at one end and fix to the screw at the other.

In the case of the technical field of writing instruments, some tubular gripping elements are known which are coupled by sliding onto the writing instrument, particularly onto pencils, but normally they are very thick and soft, of non-uniform thickness and variable geometry. They are generally used as postural correctors for children with writing problems, with specific supports which force the child to adopt a singular position with their fingers, regardless of the size thereof, in many cases limiting their use depending on whether the user is right-handed or left-handed, being truly impractical and non-ergonomic for most users. As an example, one can look at the patent of application U.S. Pat. No. 5,143,463.

In the case of ballpoint pens, the use of gripping elements is also known which facilitate the handling and operation thereof during writing. These elements are immobilised and built into the structure of the ballpoint pen itself.

DESCRIPTION OF THE INVENTION

The present invention relates to a gripping element with a tubular configuration, made of flexible plastic or rubber material, equipped with two openings, preferably of different diameters, which has different applications, amongst which fundamentally stand out its use in screwdrivers as a gripping element intended to be inserted on the screwdriver rod so that it allows the establishment of a link between the tip of the screwdriver and the screw head during the execution of the screwing and unscrewing operations, by means of coupling the screw head at one of the openings thereof or optionally through magnetic attraction by means of the additional collaboration of a magnet built into the tubular element. Likewise, the tubular element facilitates the precise fastening of the screwdriver near the tip during the use thereof.

The flexibility of the material of this tubular element makes it possible an easy assembly and disassembly, facilitating the exchange thereof, as well as the possibility of using it on different screwdriver rods, whether they are hexagonal, cylindrical or electrically insulated, normally called VDE, with different points, or as we will call them hereinafter, mouths.

The gripping element shows a tubular configuration, with an external surface equipped with several stretches of a reduced and consistent thickness in each one of its radial cross-sections, which makes it possible a comfortable adaptation to the rod, as it has a reduced volume and slightly projects radially and uniformly in all directions with respect to the rod, permitting an easy gripping which makes it very comfortable to handle and reduces fatigue during its use.

The external surface of the gripping element shows a stretch with a certain bumpy texture, preferably defined by perimeter grooves, which facilitates its fastening during rotation.

The additional grip function provided by this tubular element on the screwdriver makes it possible one to use their fingers on one hand on this tubular element, while they grip the screwdriver handle with the other hand, contributing to increase the torque and precision in performing the screwing or unscrewing operation near the tip of the rod. This is an advantage with respect to the conventional use of the screwdriver, which does not include this element and which is held with a single hand on the handle.

On the other hand, it must be highlighted that the gripping element is of a flexible material and has an inner diameter in some of the stretches thereof that is smaller than the diameter of the rod, so that the coupling and adaptation thereof to the diameter of the rod is guaranteed through elastic deformation and with a certain amount of pressure, thus permitting the displacement of the gripping element with slight resistance along the rod until its immobilisation in the desired position.

On the other hand, the incorporation of the aforementioned perimeter grooves in one of the sections allows the gripping element to have a spring effect which facilitates the displacement thereof during the placement or removal of said element towards/away from the rod, which could be, in principle, made slightly difficult by the drag effects which would be caused by the difference in diameters described in the preceding paragraph.

It has been provided that at least one of the openings of the tubular element extends inwardly in a first cavity intended for the coupling thereof on the screw head whereto the tip of the screwdriver is directed, so that the built-in screw is fixed and positioned with the screwdriver, which largely facilitates the screwing or unscrewing operation. Likewise, the tubular element can have its other opening, situated at the opposite end, extended in a second internal cavity of different diameter for the coupling thereof at the screw head of a different diameter. Therefore, a single tubular gripping element can be used directly or the other way round, to adapt better to the diameter of the screw head whereto it is to be fixed.

The first cavity can have a diameter equal to the opening until it bends, wherefrom this inner cavity gets wider, this bend constituting a retention system which facilitates the fixing of the screw head once inserted. On the other hand, on the outer surface, corresponding to the second internal cavity, it has been provided that a perimeter channel is incorporated which houses an elastic joint, which in turn facilitates the retention of the screw when the tubular element, with light pressure, is coupled on the screw head, and after exceeding a certain depth inside said cavity. This joint can have different colours and likewise be constituted in a distinctive or identifying element.

It should be mentioned that both the bend of the first cavity and the elastic joint housed in the perimeter channel of the second cavity, described above, are devised not only as a screw retention system, when we insert it through either of the two ends of the tubular element, but further present the special feature that they permit the freedom thereof due to elasticity when, applying the final turns, we get close against the screwing surface and upon bumping against it, it retracts from its original position on the rod thanks to its sliding capability, as described in preceding paragraphs.

In general, it is considered that the gripping element is devised dimensionally so that it is applicable for a screwdriver model, equipped with a specific rod diameter, for example, for the ph1 type and for screws used with said screwdriver, or it can be dimensioned for another type of screwdriver, for example, ph2, which has a different rod diameter and for the screws with which said model can be used.

The tubular gripping element coupled on the screwdriver likewise confers a positional stability to the screwdriver when it is simply resting on a surface, protecting it from direct contact with the mouth of the screwdriver. Additionally, due to the fact that the tubular object is mainly made up of a flexible plastic material, damage to any material, component or object surrounding the tool when handled is prevented; mainly in delicate working environments such as laboratories, computer workshops, metal and painting workshops, and carpenter's workshops.

The tubular element can also slide along the rod to get into the desired position, whether it is to use it as a supporting element for one's fingers or to increase the visibility of the screwing area or to be able to work in spaces that are tough to access.

The tubular gripping element object of the invention can also be used for screwdrivers used in medium or high voltage electrical applications that have a metal rod covered with plastic or insulating material. In this case, the gripping element made of plastic material can be used to partially or completely cover the metal tip, providing it with a greater protection against possible electric discharges.

According to a preferred solution, it has been provided that the second internal cavity has a magnet housed and tightened therein, preferably adhered, so that the positioning and coupling of the screw head on the tip of the screwdriver is established by the magnetic attraction exerted by the magnet on the screw head. This magnet preferably has an annular cylindrical configuration. The other opening of the gripping element would lack a magnet and would be used for the direct coupling thereof on the head of a screw, as previously described, providing versatility in the use of the gripping element depending on the opening used. Therefore, using the object of the invention either directly or the other way round, we will have a magnetic screw holder or a mechanical screw holder specifically useful when trying to hold screws of non-magnetic material, for example, of titanium, stainless steel, aluminium or plastic, amongst others.

It has also been provided that the abovementioned joint, which facilitates the fixing of the screw head in the application of the tubular element as a mechanical screw holder, for the case of applying the tubular element as a magnetic screw holder, said joint contributes to reinforce the fastening of the magnet.

On the other hand, it must be pointed out that the magnetic force of attraction of the magnet, combined with the flexibility of the tubular element, makes it possible a slight deformation due to traction or compression of the tubular element to facilitate the positional adjustment of the indentation of the screw head to the mouth of the screwdriver, without having to adjust the position of the screw holder. This special feature is particularly useful for adapting to the different sizes, tolerances and types of screw heads, such as for example, countersunk, raised-head, flat head, and cylindrical head screws, amongst others, in addition to offsetting the slopes or swaying of the tool.

Unlike magnetised screwdrivers, this gripping element equipped with a magnet achieves an increase in the magnetised surface area, causing a superior gripping strength, which contributes to the stable orientation and co-linear positioning of the screw with the rod.

It also must be highlighted that the tubular element, whether in its application as magnetic screw holder or even mechanical screw holder, thanks to its flexibility and ease of movement, can be removed and applied, or placed so that the indentation of the screwdriver is hidden.

In another possible application, the tubular element, in collaboration with the screwdriver, can be made up of a fixing element of a nail, perpendicularly arranged by the magnetic attraction of the magnet, so that in this situation the blow of the nail by means of a hammer is facilitated without having to hold it with one's hands. Likewise, the tubular element could be coupled to a hammer so that it is transported solidly joined thereto, being ready to be used with the hand that is not holding the hammer, to position the nail by the attraction exerted by the magnet.

There are multiple applications of the tubular element that are derived from the incorporation of the magnet, related to its use in tools, as it can serve not only to facilitate the grip or hold of screws or nails, but can also be used coupled to the tool to hang it upside down through the action of the magnet linked to a metal element.

The tubular gripping element object of the invention can also be used coupled to a screwdriver to facilitate the initial and correct positioning and screwing of a nut in a bolt, thanks to the attraction of the magnet in places that are difficult to access, where the usual manoeuvre consists of inserting the nut with a so-called socket spanner or box spanner, which is incapable of retaining and preventing its fall since it lacks magnetised materials in its configuration and forces us to use our fingers of our other hand with quite a bit of dexterity and difficulty.

As a complement, the optional possibility is considered that the tubular gripping element incorporates a bearing, which can be of plastic or metallic material, for example, situated in the magnet cavity, so that it constitutes a protection of the magnet against knocks, or rubbing from the rod, or falls suffered by the screwdriver, thus increasing its resistance to wear. This bearing could also be extended in a frontal face which would partially or completely cover the front face of the magnet to prevent wear to du rubbing up against screws and other surfaces.

According to an additional application, the possibility of displacing the tubular element along the screwdriver rod makes it possible its use for performing depth measurements, using the free surface of the rod which remains from the tip to the tubular element as a reference measurement for making adjustments or positioning that require repetitive measurements.

Another possible application of the tubular gripping element is related to its use in interchangeable electric screwdriver tips, so that it can be found coupled in different sized tips and types of indentations, exercising its function of holding screws, additionally facilitating the handling when the disassembly or assembly of the tip in the drill spindle must be performed. In this case, the perimeter grooves of the tubular element can be used by the user as a reference for making a cut therein and therefore adapt the length of the tubular element to the size of a short tip.

In another possible application, the tubular element can hold screws coupled to L-shaped spanners such as Allen or Torx spanners, amongst others.

Another application for the tubular element is related to another field, that is, it can be sued as a gripping element for writing utensils, such as, for example, propelling pencils or ballpoint pens, which through its simple insertion on the writing utensil and positioning at the suitable height, constitutes a gripping element for the fingers used to write or draw, reducing fatigue during writing and preventing the appearance of blisters on one's supporting fingers. Likewise, and due to the possibility of moving along the writing utensil, it can be used as a hood, at an end position wherein it would cover the writing tip of said utensil, in the case of the propelling pencils preventing possible breakages of the lead, as well as preventing one from sticking themselves or dirtying their clothes.

For this application, the tubular element would not have a magnet and the internal cavities could adopt a triangular or hexagonal cross-section, for example, to better adapt to the cross-section of the writing utensil.

The tubular element can be placed on the writing utensil in either direction and, due to the fact that one end is thicker than the other, it permits the user to select between two possible writing postures, depending on whether the user is right-handed or left-handed, or has large or small fingers, placing their fingers where it is most comfortable for them to write.

Likewise, within the uses of this tubular element, it's possible use at both ends of the writing utensil must be pointed out, for which two units of the element is required, one at each end, in order to play a balancing game which is becoming more and more widely played and which is called "pencil spinning".

Another possible application of the tubular element is directed at its use at the end of the propelling pencil opposite the writing tip as an eraser, the tubular element being devised with a material adapted for this purpose. The geometric and dimensional configuration makes it possible an ergonomic gripping which facilitates the erasing operation.

In this case, one of the openings is configured to couple to the free end of the propelling pencil, while at the other end of the tubular element a small drill is defined whose purpose is to prevent choking in the event that it was accidentally ingested. In this application, the tubular element can also be placed at the tip to protect the pencil lead.

It has been provided that whatever the planned application may be, the same manufacturing moulds are used to configure an external surface which is constant for all of the uses, and only the male moulds used in producing the different drills provided for the different applications are modified.

DESCRIPTION OF THE DRAWINGS

To complete the description that is being made, and with the object of assisting in a better understanding of the characteristics of the invention, in accordance with a preferred example of practical embodiment thereof, accompanying said description as an integral part thereof, is a set of drawings wherein, by way of illustration and not restrictively, the following has been represented:

FIG. 12 shows the tubular element with the same application of holding a nail, but applied to a screwdriver.

FIG. 13 shows an embodiment of the tubular element cross-sectional with another geometry for its application to propelling pencils, wherein a sectional view, FIG. 13A, has also been represented to view the hexagonal cross-section.

FIG. 14 shows a perspective view of the tubular element applied on a propelling pencil in one direction.

PREFERRED EMBODIMENT OF THE INVENTION

Figure 2:
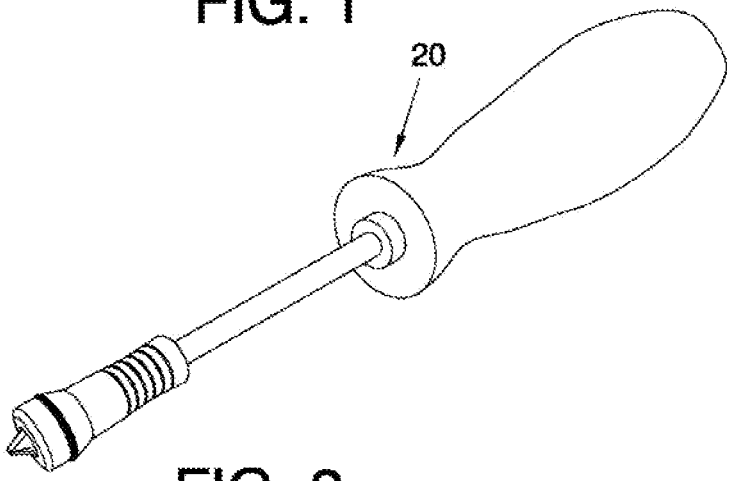
FIG. 2 shows a perspective view of the tubular element coupled to a screwdriver.
Figure 15:
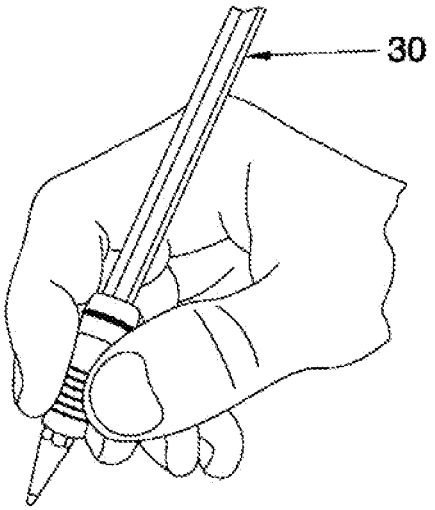
FIG. 15 shows a perspective view of the tubular element applied on a propelling pencil in the opposite direction.
Figure 16:
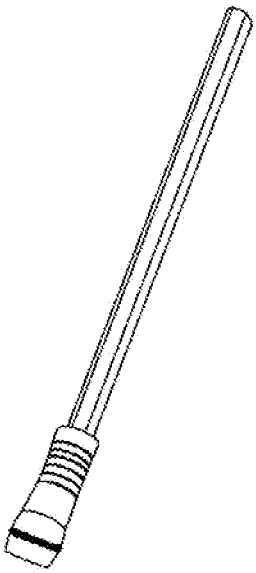
FIG. 16 shows the tubular element coupled on a propelling pencil covering the tip thereof.
Figure 19:
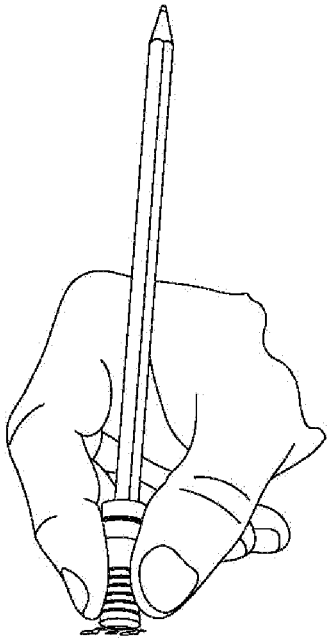
FIG. 19 shows a representation of the tubular element on the head of the propelling pencil during the erasing action.

In light of the figures, several examples of embodiment of the tubular gripping element object of the present invention are disclosed, the invention being specially applicable, for example, for tools, such as screwdrivers (20), as represented in FIG. 2, as well as to facilitate the gripping of writing utensils (30), as observed in FIG. 15, or as an eraser, as observed in FIG. 19.

Figure 1:
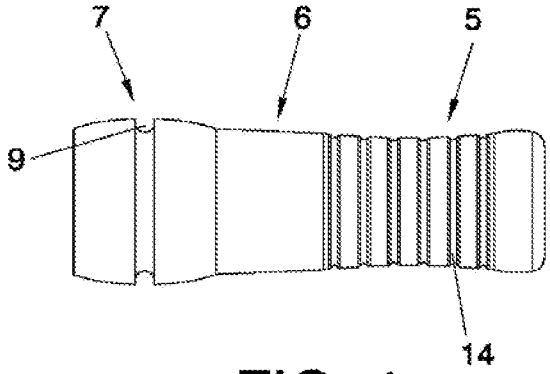
FIG. 1 shows a side view of the tubular element object of the invention.
Figure 3:
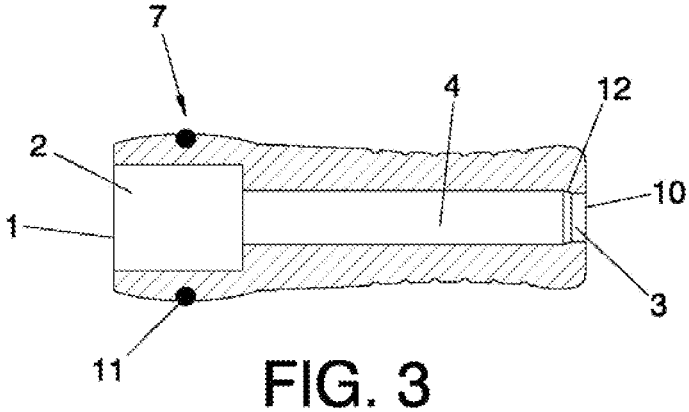
FIG. 3 shows a cross-sectional side view of a possible embodiment of the tubular element for its mechanical application, without magnet.

FIG. 3 shows that the tubular gripping element is equipped with two openings (1, 10) wherefrom corresponding cavities start (2, 3), and has an external surface of several stretches of reduced thickness and constant in each one of its radial cross-sections, amongst which is distinguished a first bumpy stretch (5) defined by perimeter grooves (14), as observed in FIG. 1, which facilitates the holding thereof and causes a longitudinal flexibility to facilitate its displacement and positional adaptation to the screwdriver rod. As observed, the bumpy stretch (5) has a convex configuration which facilitates the gripping of the tubular element.

The exterior surface of the tubular element also has an intermediate stretch (6) and an end stretch (7), preferably of domed configuration.

Figure 4:
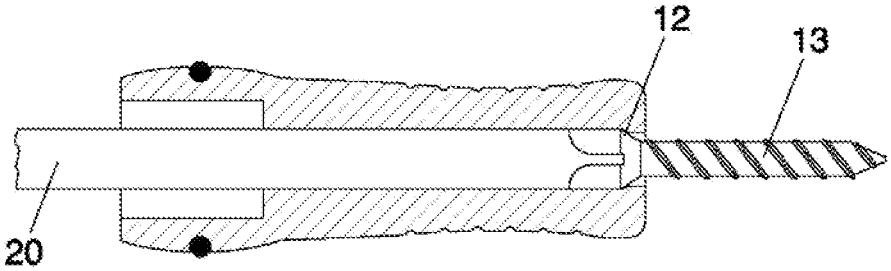
FIG. 4 shows a cross-sectional view of the embodiment from FIG. 3 wherein one can observe a screw in the broadening part which facilitates the gripping and expulsion of its head and a screwdriver coupled to the screw.

As observed in FIG. 3, inside the first cavity (3), which starts from the first opening (10), a bend (12) is defined which determines a widening of said first cavity (3) to facilitate the coupling of the screw head (13), as observed in FIG. 4. As a continuation of the first cavity (3) and after said bend (12), a third or intermediate cavity (4) is observed in FIG. 3.

Figure 5:
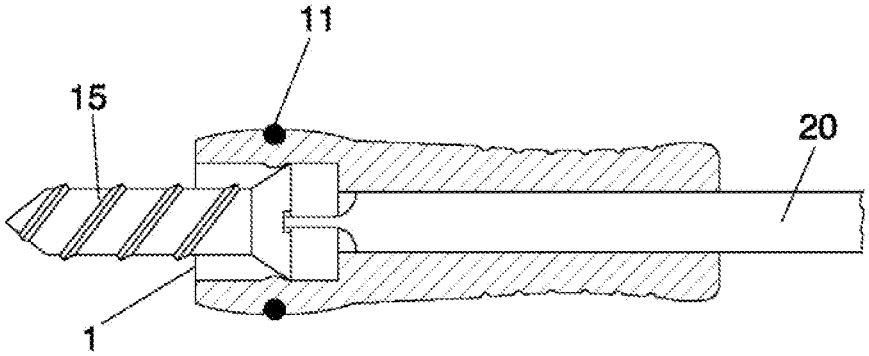
FIG. 5 shows a cross-sectional view of the embodiment from FIG. 3 wherein one can observe a larger screw than that from FIG. 4 coupled at the opposite opening.

It has been provided that the end stretch (7) incorporates a perimeter channel (9) intended to house a joint (11), as observed in FIG. 1. This joint (11), combined with the flexibility of the tubular element, facilitates the coupling of a larger screw head (15) through the second opening (1) in the second cavity (2), as can be observed in FIG. 5, since corresponding to the position of the joint (11), a slight elastic deformation is produced, as observed in FIG. 5, which holds the larger screw head (15).

Figure 6:
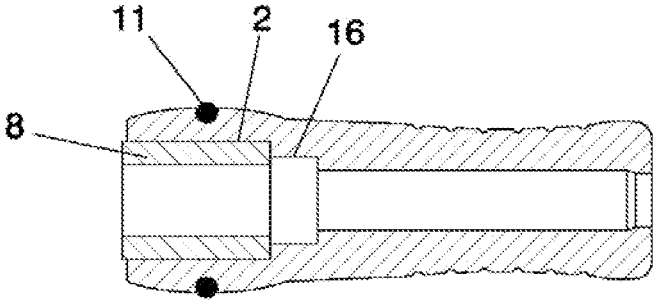
FIG. 6 shows a cross-sectional view of the tubular element in the case of incorporating a magnet in the interior thereof.
Figure 7:
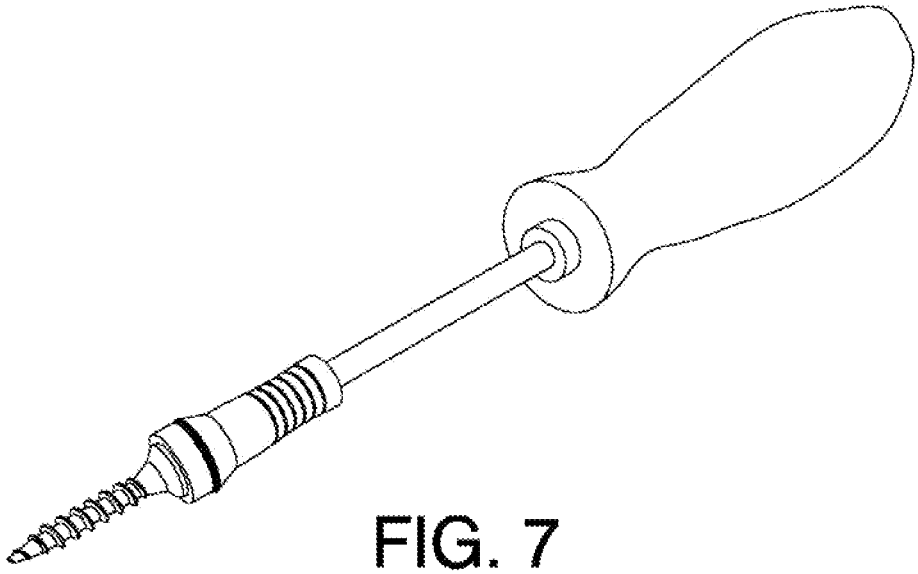
FIG. 7 shows the tubular element from FIG. 6 coupled to a screwdriver with the screw head positioned by the attraction of the magnet.

FIG. 6 shows an embodiment wherein the tubular gripping element houses a magnet (8). In this case, it has the second cavity (2) which starts on the inside from the second opening (1) intended to house the magnet (8). In said FIG. 6, another additional cavity (16), adjacent to the second cavity (2), is observed, and is intended to receive the excess adhesive material which is used to link the magnet (8) to the second cavity (2), as well as to improve the spring effect.

In this case, as observed in FIG. 6, the joint (11) assists in the fixing of the magnet (8) inside the cavity (2).

Figure 8:
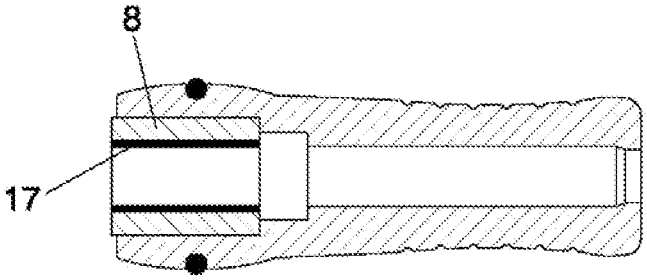
FIG. 8 shows a cross-sectional view of the tubular element with magnet which complementarily incorporates a magnet protecting bearing.
Figure 9:
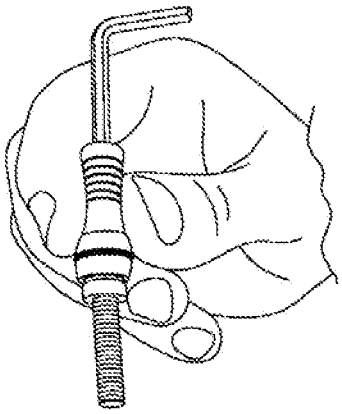
FIG. 9 shows the tubular element applied in an Allen spanner.
Figure 10:
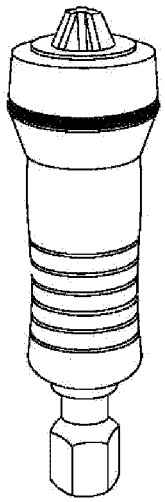
FIG. 10 shows the tubular element coupled in a screwdriver tip.
Figure 11:
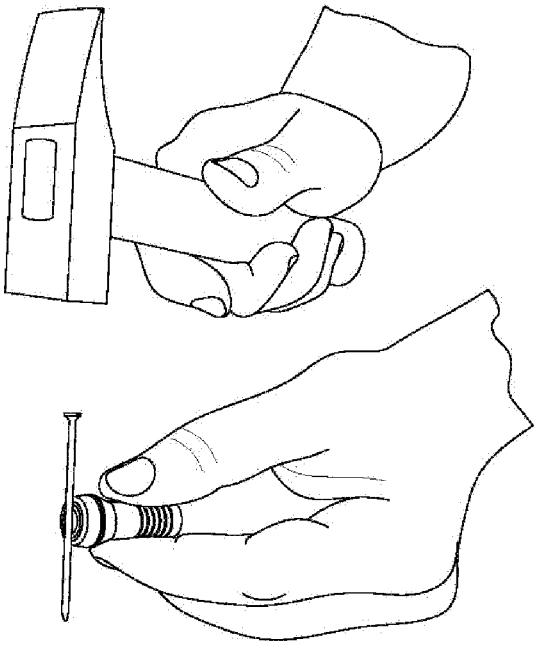
FIG. 11 shows the tubular element in its application of nail holder to facilitate the hitting of a nail with a hammer.

FIG. 8 shows the solution wherein the tubular gripping element incorporates a bearing (17) situated inside the magnet (8) in order to protect the magnet.

Figure 20:
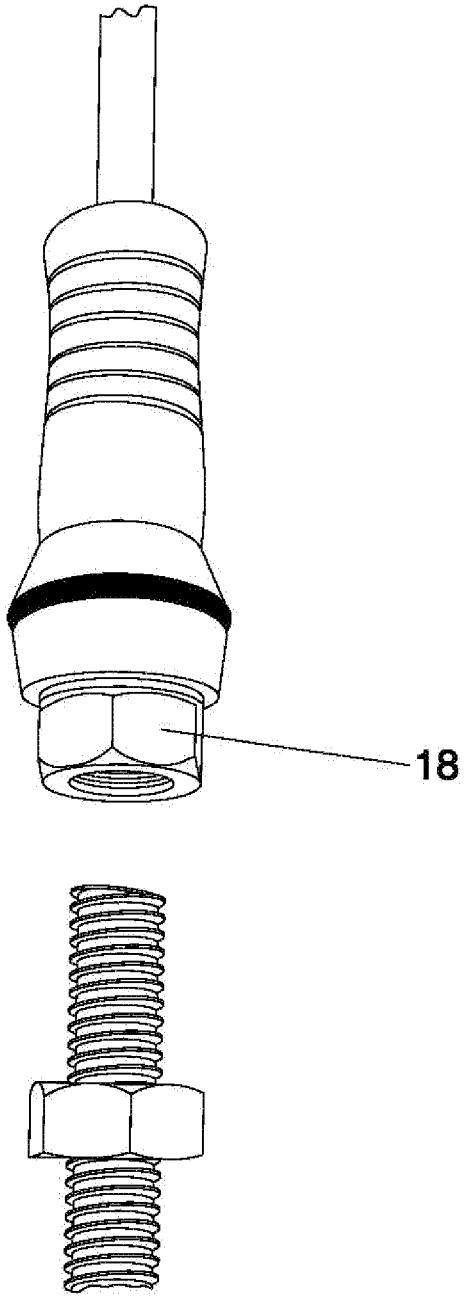
FIG. 20 shows the application of the tubular element coupled on a screwdriver which holds a nut by means of the magnet to facilitate its placement on a bolt.
Figure 21:
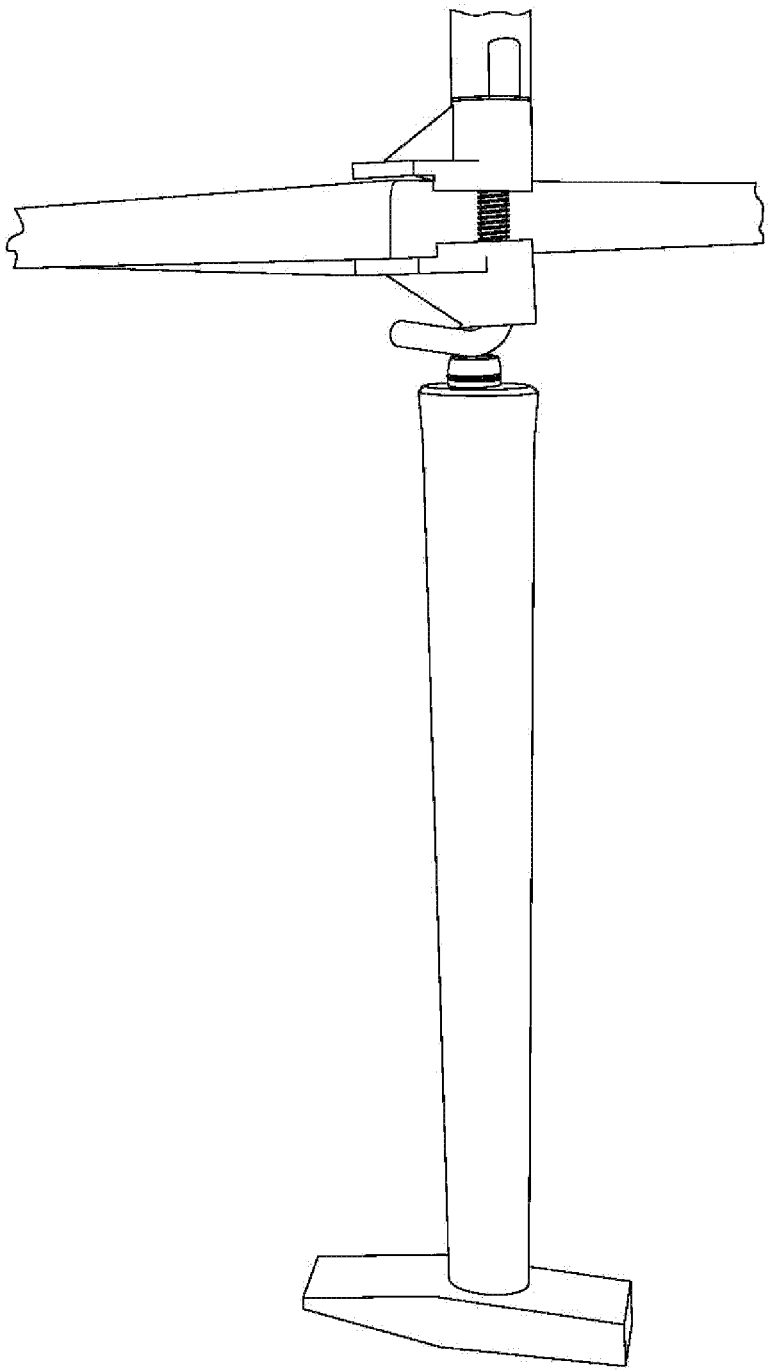
FIG. 21 shows a perspective view of the tubular element in its application to facilitate its use with a hammer and to hang said hammer.
Figure 22:
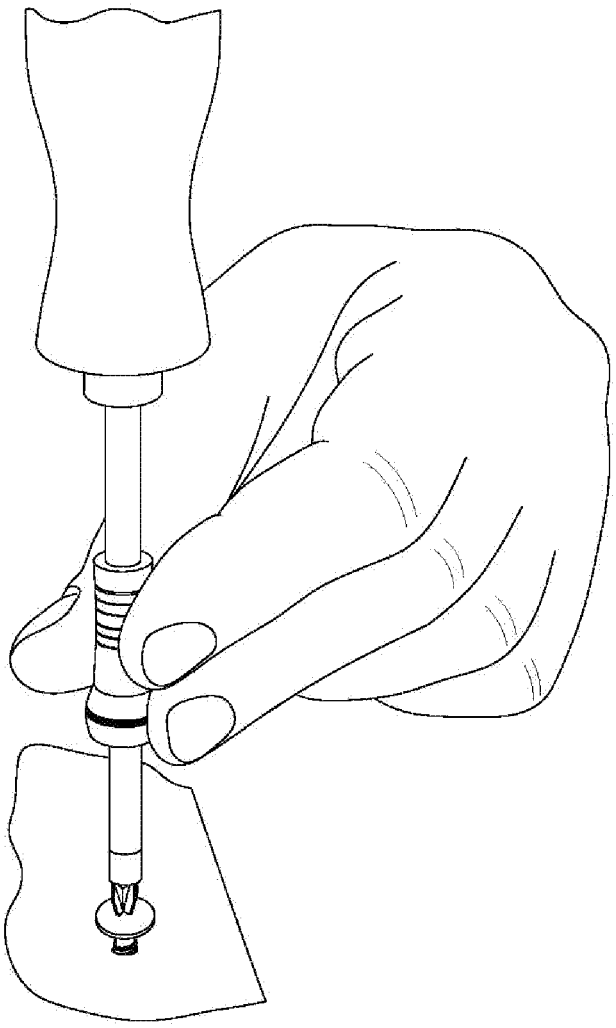
FIG. 22 shows a view of the application of the tubular element coupled on the screwdriver in a position wherein it assists in the precise gripping and rotating action during the screwing or unscrewing operations.

FIG. 20 shows that the tubular element coupled to a screwdriver (20) makes it possible, by means of the magnet (8), to attract a nut (18) to facilitate the correct positioning and initial screwing thereof on a bolt, thus preventing it from passing the first thread when beginning to screw it and leaving it in a twisted position.

On the other hand, FIG. 13 shows another embodiment of the tubular element which incorporates a hexagonal cross-section in the first cavity (3), FIG. 13A, to facilitate its coupling to a propelling pencil (30), as observed below in FIG. 15.

Figure 17:
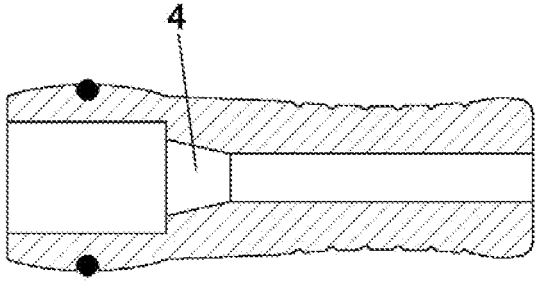
FIG. 17 shows a cross-sectional view of another embodiment of the tubular element in its application as an eraser.
Figure 18:
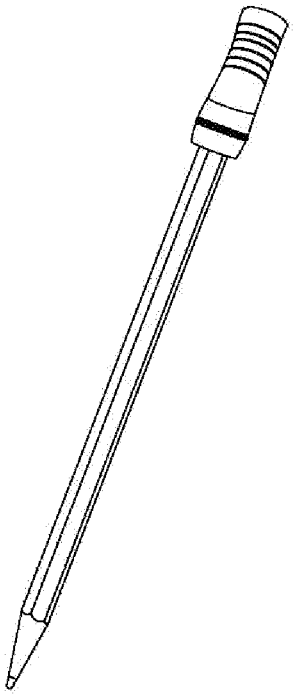
FIG. 18 shows a view of a propelling pencil with the tubular element coupled with the function of an eraser.

FIG. 17 shows another embodiment of the tubular element for its application as an eraser, wherein it is observed that the first cavity (3) is very small and is fitted with an anti-choking security function. Likewise, it can be observed that in this case the intermediate cavity (4) has a truncated conical configuration which also facilitates the application of this eraser for its adaptation through this intermediate cavity (4) to the conical form of the pencil tip to cover it.

The invention claimed is:

1. A removable tubular gripping element comprising a tubular body made of a flexible material, said body comprising:

a curved surface formed by a first stretch fitted with perimeter parallel grooves, an end stretch fitted with a perimeter channel, and an intermediate stretch located between the first stretch and the end stretch, two parallel bases defined at the ends of the curved surface, the body further comprising:

a first opening defined on one base of the two parallel bases, wherefrom inwardly a first cavity starts, a second opening defined on the other base of the two parallel bases, wherefrom inwardly a second cavity starts, an intermediate cavity located between the first and the second cavity, which has a bigger diameter than the first cavity, a bend defined between said first cavity and said intermediate cavity determining a widening for the coupling of a head of a screw, and a fixing band housed in the perimeter channel.

2. The removable tubular gripping element according to claim 1, wherein a magnet is housed in the second cavity.

3. The removable tubular gripping element according to claim 2, wherein the magnet is of annular cylindrical configuration.

4. The removable tubular gripping element according to claim 3, further comprises a bearing situated inside the magnet.

5. The removable tubular gripping element according to claim 2, the magnet is adhered in the second cavity.

6. The removable tubular gripping element according to claim 5, further comprising an additional cavity, located between the second cavity and the intermediate cavity.

7. The removable tubular gripping element according to claim 1, wherein both the first cavity and the intermediate cavity have a hexagonal cross section.

8. The removable tubular gripping element according to claim 1, wherein the first cavity has a cylindrical cross-section with a smaller diameter than the diameter of the second cavity.

9. The removable tubular gripping element according to claim 1, wherein the first stretch has a convex configuration.

* * * * *